US006253631B1

(12) United States Patent
McCain et al.

(10) Patent No.: US 6,253,631 B1
(45) Date of Patent: Jul. 3, 2001

(54) PUMPING UNIT LOCK DOWN APPARATUS

(75) Inventors: Gary Richard McCain; James Robert McCain, both of Bakersfield, CA (US); Donald J. Lewis, Henderson, NV (US)

(73) Assignee: Bac-Lamb Wire Line Services, Bakersfield, CA (US)

( * ) Notice: Subject to any disclaimer, the term of this patent is extended or adjusted under 35 U.S.C. 154(b) by 0 days.

(21) Appl. No.: 09/460,493

(22) Filed: Dec. 14, 1999

Related U.S. Application Data

(60) Provisional application No. 60/115,812, filed on Jan. 14, 1999.

(51) Int. Cl.[7] ..... F16H 21/32; F01B 23/08

(52) U.S. Cl. ..... 74/41; 74/532; 24/68 CT; 24/69 WT; 248/72; 248/228.1; 254/234

(58) Field of Search ..... 74/41, 532; 24/68 CT, 24/69 WT; 248/72, 228.1; 254/233, 234

(56) References Cited

U.S. PATENT DOCUMENTS 301,940 * 7/1884 Wall ..... 254/234
2,877,974 3/1959 Estes .
3,084,893 4/1963 Ruth .
4,092,872 6/1978 McClure .
4,525,914 7/1985 Bryan et al. .
4,799,639 1/1989 Riley .
5,146,724 * 9/1992 Angelo ..... 52/299
5,169,277 * 12/1992 Orser et al. ..... 414/685

* cited by examiner

*Primary Examiner*—Allan D. Herrmann
(74) *Attorney, Agent, or Firm*—Henry M. Bissell; Henry M. Bissell, IV

(57) ABSTRACT

A lock down apparatus for use with an oil well pumping unit of the walking beam type. It includes upper and lower clamps for attachment to the walking beam and to the bottom frame of the unit, respectively, and an adjustable tensioning arrangement extending between the two clamps. Part of the tensioning unit is a wire rope with plastic buttons pressed onto the rope at suitably spaced intervals. A coupler for latching to the particular button which is selected for adjustment for the distance between the walking beam and its frame is provided. Once the tensioning unit is in place, a turnbuckle is tightened to increase the tension to hold the walking beam in a lowered position, against inadvertent release of the pumping unit safety brake.

18 Claims, 5 Drawing Sheets

PUMPING UNIT LOCK DOWN APPARATUS

CROSS-REFERENCE TO RELATED APPLICATION

This application claims the benefit of U.S. Provisional Application No.: 60/115,812, filed Jan. 14, 1999.

BACKGROUND OF THE INVENTION

1. Field of the Invention

This invention relates generally to safety devices used to secure equipment in place and enable the performance of maintenance or other work on such equipment with safety. More particularly, the invention relates to lock down devices used to preclude movement of a loaded oil well pumping unit and thereby permit work on it to be performed safely.

2. Description of the Related Art

In industry, motor-driven machinery and other equipment frequently require securing in order to permit maintenance and/or modifications to be performed in complete safety, free from the concern that the equipment could move suddenly. Precautionary measures, such as the applying of brakes and the shutting off of engines or electrical power, are common means of increasing workplace safety. Such safeguards and practices occasionally fail or are overlooked, so multiple redundant systems are often used.

In the petroleum industry, a variety of methods are used for extracting oil from underground reservoirs. Perhaps one of the most common of these methods is an oil well pumping unit known as the "walking beam" type. With some imagination, these walking beam pumping units resemble giant grasshoppers, each one seesawing its giant pump arm up and down as it lifts oil from underground.

In the course of regular maintenance or modifications, a lift rod connected to the head of the pump arm must be disconnected. To perform this operation, the pump arm is operated through its up-down cycle until the pump arm brings the pump head down to its lowest position, closest to the ground. At this point the unit is stopped and a safety brake is applied.

In current practice, a chain is passed over the pump arm and secured to the platform or base of the pump unit. The addition of this secured chain provides an added degree of safety, should the safety brake mechanism fail. Such an arrangement is similar to that set forth in U.S. Pat. No. 4,525,914 issued to Bryan et al. The Bryan patent uses chain for securing the horsehead of an oil well pump, but does not provide the additional ease and safety afforded by the present invention.

The installation and securing of a chain over a pump arm requires rig personnel to climb up on the pump unit in order to manually pass the chain over the pump arm. As maintenance and repair operations are performed in the field, the rig personnel must scale the pump unit, frequently without safety gear or other fall protection devices, all the while at considerable distance from emergency medical care. Additionally, if the chains used for this purpose are not regularly inspected and tested, they may fail without warning. The failure of a chain may allow the pump arm to spring upward suddenly and cause substantial damage to the pump unit and other rig equipment, as well as seriously injure rig personnel. Commonly used walking beam pump units require rig personnel to scale the unit to heights of 20 to 30 feet in order to pass a safety chain over the pump arm. A slip or fall from such height could easily result in serious injury. U.S. Pat. No. 4,092,872 issued to McClure disclosed a safety attachment for an oil well horsehead utilizing jointed parallel straps. The McClure patent does not teach the lock down safety features of the present invention.

Several patents disclose clamping arrangements for attaching to a flanged beam. Examples of such clamping arrangements are taught in U.S. Pat. Nos. 2,877,974 of Estes, U.S. Pat. No. 3,084,893 of Ruth and U.S. Pat. No. 4,799,639 of Riley. However, none of these patents teaches or suggests the structural combination of the present invention.

SUMMARY OF THE INVENTION

The present invention provides a lock down apparatus for securing structural members or heavy machinery. The lock down apparatus may be used generally to secure structural members and/or heavy machinery during maintenance or modification in order to permit safe work thereon. The lock down apparatus is particularly useful when applied to the walking beam type oil pumping units commonly used in the petroleum industry.

The advantages of the present invention are substantial. The lock down apparatus of the present invention eliminates the need for rig personnel to scale the pump arm, thereby greatly reducing the risk of injury from falls. The lock down apparatus may be installed while personnel remain at ground level. Arrangements of the present invention are designed to support the load of the pump arm or beam against its counterweight and, in so doing, become a primary safety feature while relegating the safety brake to secondary safety feature status. The present invention enables rig workers to secure the pump arm at one of a number of desired positions or heights without any need for the worker to leave the ground. The use of wire rope in the present invention permits ready visual inspection of the structural integrity of the lock down apparatus in marked contrast to prior art methods involving the use of chain.

One particular arrangement of the present invention employs an upper secured clamp which may be installed directly and permanently to the wide flange portion of the "I" beam comprising the pump arm. Since the installation of the upper clamp is permanent, wear and risk of damage to the pump arm is reduced and the security and safety afforded by the present invention are improved. The present invention greatly reduces both the possibility of damaging the pump and the risk of great bodily harm resulting from some alternative arrangement slipping or shifting position under load The present lock down apparatus is safe and simple to use. Initially, an upper clamping device is used to permanently affix a top assembly hook to the pump arm. The clamping device attaches securely to the wide flange portions of the "I" beam comprising the pump arm.

When maintenance schedules require a pump arm to be secured, rig personnel stop the pump unit with the pump arm horsehead in its desired, lowered position. The safety brake is then applied, and rig personnel install the lock down apparatus as follows. A bottom bracket is installed to provide a lower securing point below the upper clamp assembly permanently installed on the pump arm. The bottom bracket or clamp slides over and engages a section of "I" beam used as a base for the pump unit or, as is frequently found, molded into the concrete pad upon which the pump unit sits. The bottom bracket may be equipped with hooks to engage an orthogonally situated "I" beam in order to prevent the bottom bracket from moving out of position.

A cable portion of the lock down apparatus is made up from suitable wire rope material, such as ⅝" diameter wire rope. An "eye" is provided at one end, either through braiding or the use of a cable crimp or a preformed loop connector to which the wire rope is swaged or otherwise connected. The resulting "eye" engages the hook of the upper assembly which is clamped to the pump arm.

Starting at the "eye" and proceeding down the length of the cable portion, one encounters a series of "buttons" or stops affixed to the wire rope at selected intervals. These buttons are securely pressed onto the wire rope or otherwise secured to prevent their movement or slippage under strain, and can be selected as the attaching element connected to the remainder of the lock down apparatus. The relatively close spacing of these buttons enables quick and easy incremental adjustment of the secured positioning of the pump arm, thereby varying the effective length of the flexible cable portion of the overall tensioning assembly of the lock down apparatus.

A threaded adjustment portion of the lock down apparatus is secured at its lower end to the bottom clamp while the opposite, upper end is terminated with a "hairpin" connector for engaging a selected button of the wire rope portion.

To use the present lock down apparatus, the lower end of the wire rope is passed through the large open portion of the hairpin connector and a selected button is engaged in the narrower engaging portion of the hairpin connector. This narrower portion of the hairpin connector is sized to receive the wire rope, but will not permit passage of the buttons on the wire rope.

After the wire rope has been transferred from the open portion to the engaging portion of the hairpin connector, the "eye" of the wire rope portion is lifted to engage the hook affixed to the pump arm. The lower end of the apparatus is attached to the bottom clamp and thereafter the threaded adjustment portion of the present invention, a single turnbuckle in the preferred embodiment, is adjusted to tighten the lock down apparatus. Once the threaded adjustment portion has been adjusted to apply tension to the lock down apparatus, the safety brake may be released so that the full tensional load of the pump arm is taken up by the lock down apparatus. The safety brake is then reapplied and work may proceed in safety.

All portions of the lock down apparatus of the present invention are engineered and tested to withstand loads in excess of four times greater than those likely to be encountered in the field, thereby providing a great degree of safety.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENT

Figure 1:
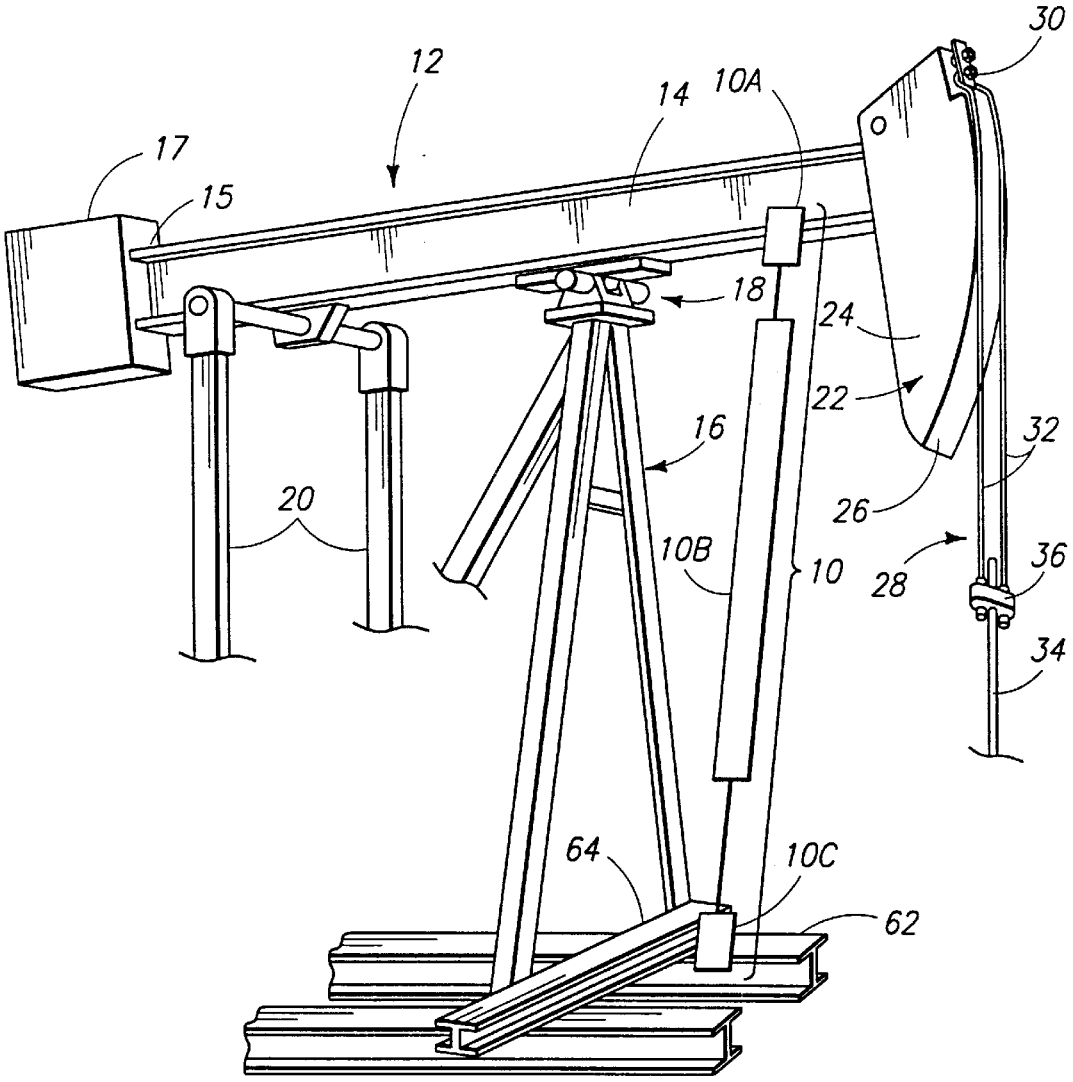
FIG. 1 is a schematic representation, partially broken away, of a conventional oil well pumping unit with which embodiments of the present invention are designed to be used.

The preferred embodiment of the lock down apparatus 10 of the present invention is shown in structural detail in FIGS. 2–7 and is designed to be installed on a pumping unit, such as that which is represented in FIG. 1, generally designated by the numeral 12, in the manner indicated by the block portion of the diagram. Pumping unit 12 includes a walking beam 14 pivotably supported by a samson post 16 for pivotal movement about a generally horizontal axis defined by a center bearing assembly or saddle bearing 18. The beam has a pitman assembly or crank rods 20 connected to the beam 14 near the end 15 where a counterbalance weight 17 is attached. The pitman assembly is driven to cause the beam 14 to oscillate or pivot in a vertical plane about the transverse horizontal axis of the saddle bearing 18.

The other end of the beam 14 has a horsehead 22 connected thereto. The horsehead 22 is of conventional construction and includes a pair of side plates 24 and an arcuate outer face or plate 26. A wire line assembly 28, sometimes called a wire rope bail, is attached to the horsehead by a conventional wire line hanger 30 at the upper end of the arcuate member 26, with the cables or wire lines 32 engaged by the arcuate member 26 during swinging movement thereof to maintain the line of force exerted by the wire line assembly 28 in proper alignment with a polished rod 34 so that it will properly reciprocate a sucker rod or pump rod associated with a downhole pump (not shown). The cable 32 is connected to the polished rod by a carrier bar and polished rod clamp 36 in a conventional manner. All of the aforementioned structure except for the lock down apparatus 10 is conventional and forms no particular part of the present invention except for the association of the lock down apparatus 10 therewith.

The lock down apparatus 10, the structural details of which are shown in FIGS. 2–7, is represented in FIG. 1 by three connected blocks. The upper and lower blocks 10A and 10C are devices for clamping to the walking beam of the pump unit and one of the beams making up the base frame of the unit, respectively. Block 10B represents the intermediate portion of the lock down apparatus extending between the clamp devices 10A and 10C.

Figure 2:
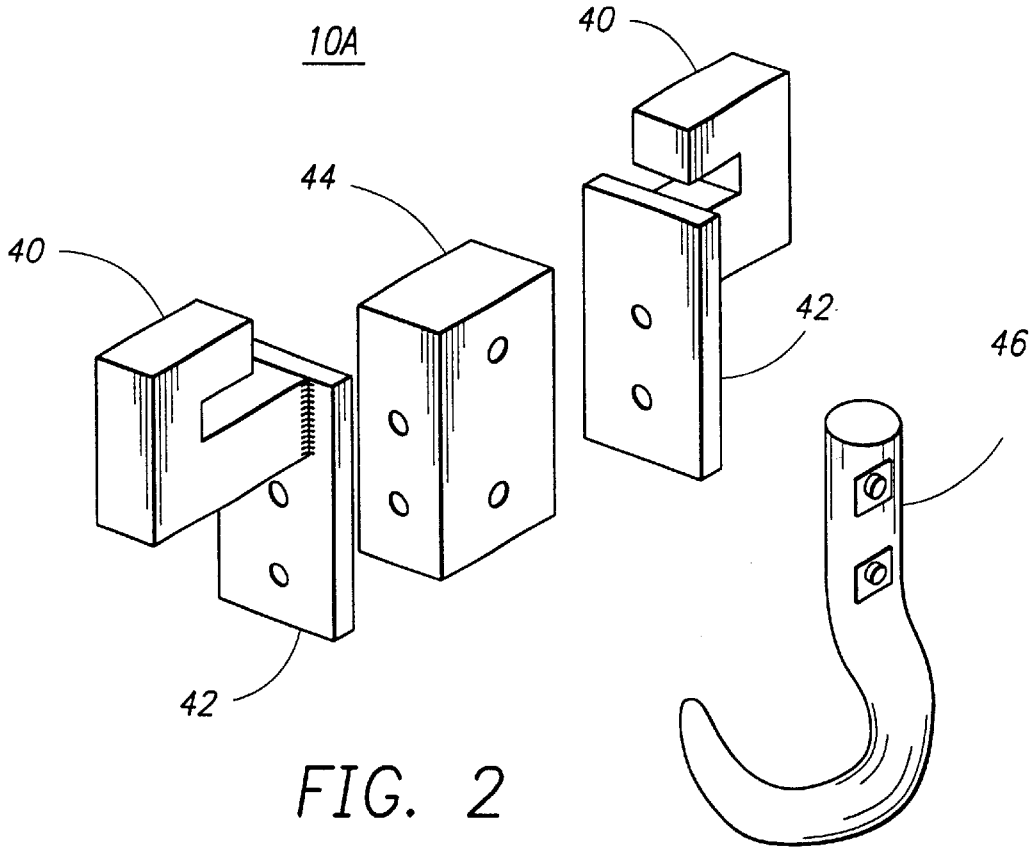
FIG. 2 is an exploded view of a beam clamp assembly which is one particular portion of the present invention.
Figure 3:
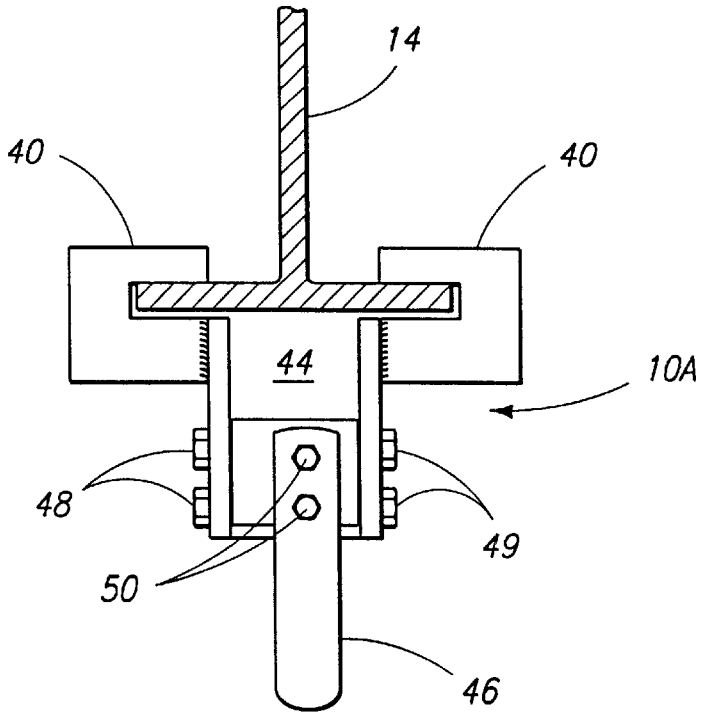
FIG. 3 is a schematic view of the beam clamp assembly of FIG. 2, shown installed on the pump arm beam.

Referring to FIGS. 2 and 3, details of the upper beam clamp, 10A of FIG. 1, are shown. In the exploded view of FIG. 2, the clamp is shown comprising a pair of symmetrical, generally C-shaped, half-clamps 40, each of which is attached, as by welding, to a corresponding side plate 42. Between the two side plates 42 is a mounting block 44 which is provided with a first set of holes for attachment to the two side plates 42 and with a second set of holes for mounting a cable hook 46. These parts are shown assembled in FIG. 3 with the half-clamps 40 firmly engaging the lower flanges of the I-beam 14 of the pump unit of FIG. 1. Bolt heads 48 and nuts 49 are shown as used in attaching the two side plates 42 to the central block 44. Additional bolts 50 are shown attaching the hook 46 to the central block 44. This arrangement of the beam clamp of the invention is designed to be permanently installed on the walking beam 14, thereby avoiding the hazard of requiring maintenance personnel to climb up on the walking beam whenever arrangements of the invention are to be used for locking down the pumping unit.

Figure 4:
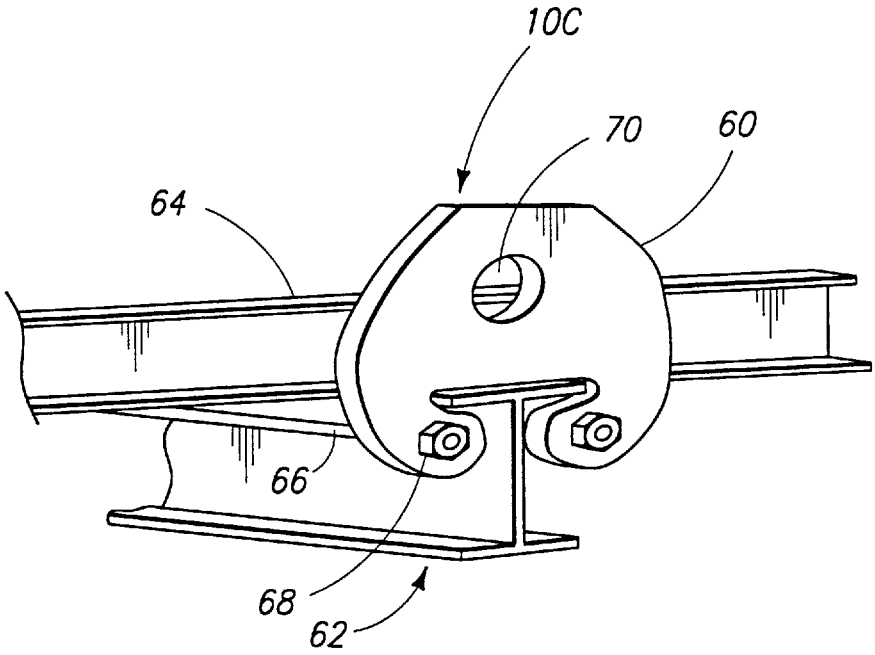
FIG. 4 is a schematic perspective view, partially broken away, of one particular portion of the present invention shown installed on the base frame of the pumping unit of FIG. 1.
Figure 5:
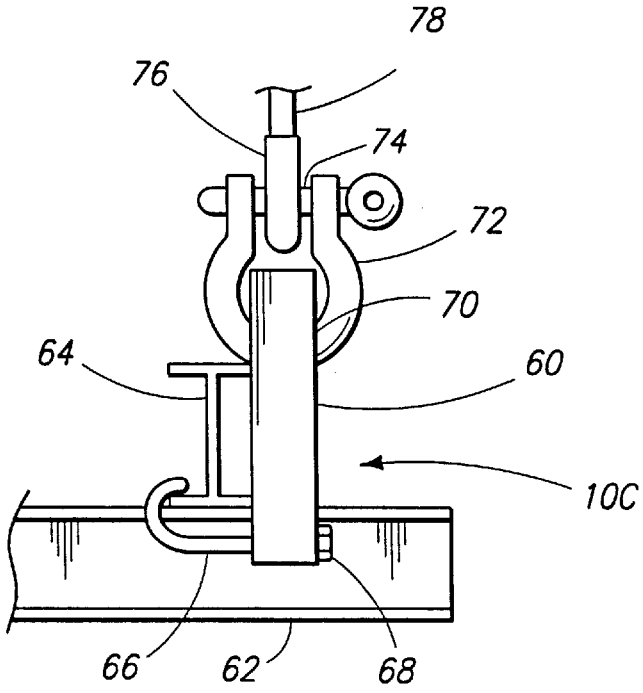
FIG. 5 is a schematic side view corresponding to the portion depicted in FIG. 4.

Structure making up the lower clamp 10C (FIG. 1) is shown in FIGS. 4 and 5. This mainly comprises a gripping element 60 which is shaped with a cutout in the lower portion which permits the element 60 to be slid over the end of a lower frame rail 62 and up against the edges of a cross rail or beam 64. Safety hooks 66 are provided to retain the element 60 against the rail 64. These are held in position, once the element 60 is in place, by threaded nuts 68. The element 60 is shown having a large opening 70. This is for the purpose of receiving the clevis 72 when the lock down apparatus is set up for use.

In FIG. 5, the clevis 72 is shown placed through the opening 70 with its clevis pin 74 retaining one end of a turnbuckle 80. The upper end 82 of the turnbuckle 80 is attached by another clevis 84 with associated clevis pin 86 to the loop 88 of a "hairpin" coupler 90. The opposite ends of the loop or link 88 are attached, as by welding, to an inverted cylindrical cup 92 which is provided with a slot 94 extending up one side and across to about the center of the upper end of the cup 92. The width of the slot is sufficient to receive an associated wire rope or cable (FIG. 7) therein.

Figure 6:
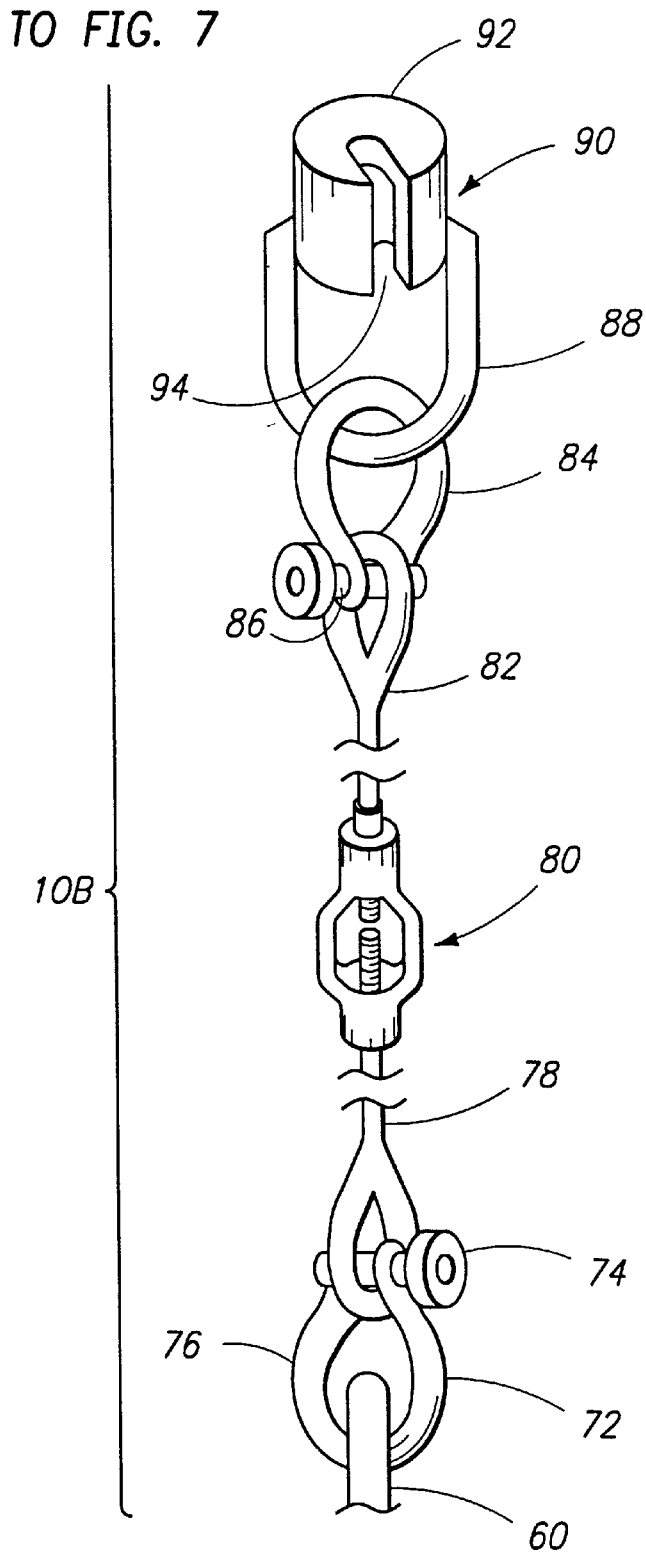
FIG. 6 is a schematic representation of a portion of the embodiment of the present invention which is used for adjusting the tension of the lock down apparatus after installation.
Figure 7:
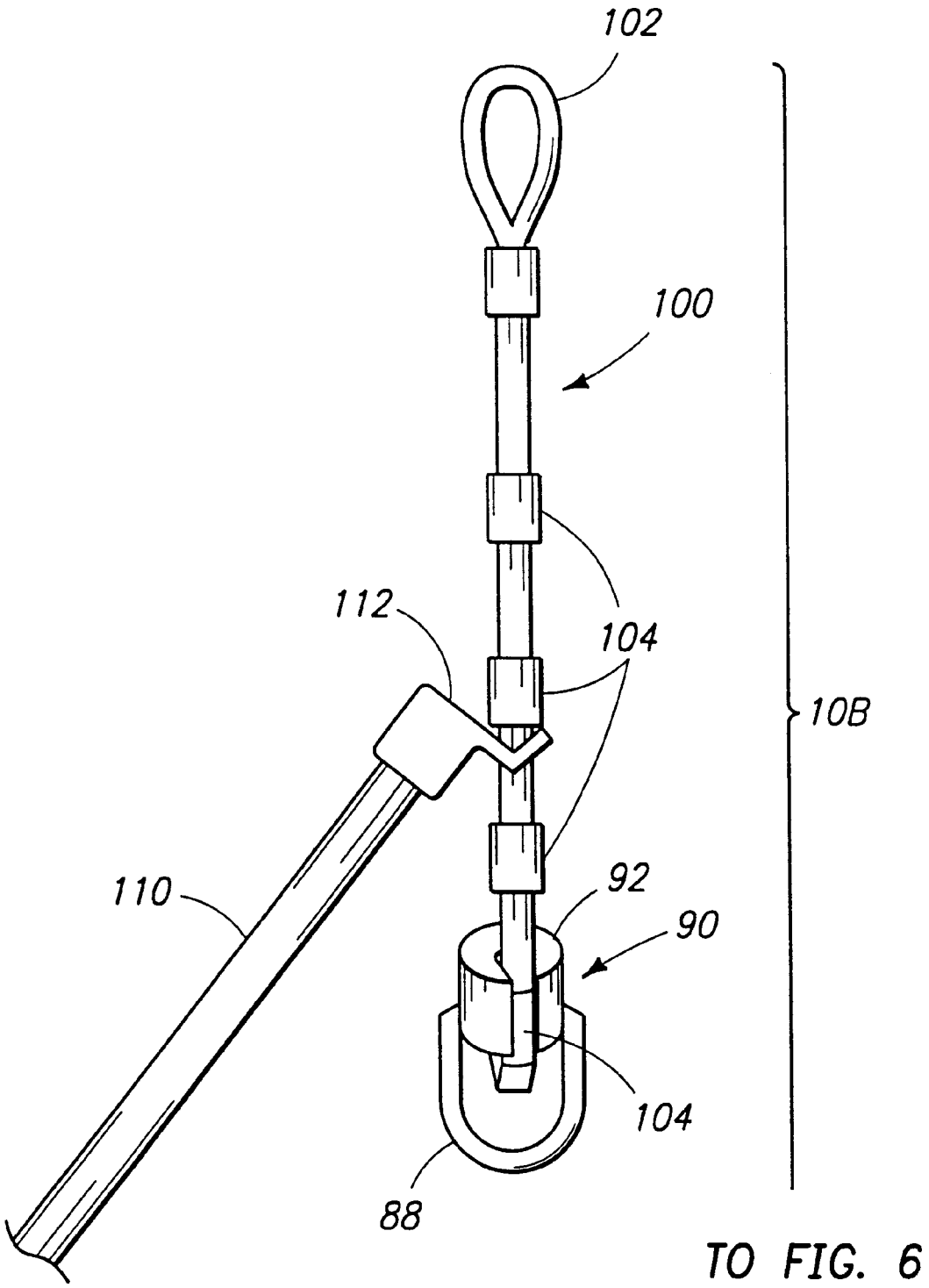
FIG. 7 is a schematic view, partially broken away, of a section of wire rope or cable shown with a lifting pole for attaching the lock down apparatus to the upper beam of the pumping unit of FIG. 1.

The wire rope 100 is shown in FIG. 7 as having a loop 102 at its upper end and a series of regularly spaced buttons 104 mounted thereon. The buttons 104 are preferably formed of plastic and are pressed onto the wire rope 100 at approximately 20" spacing in order to permit adjustment of the operative length of the wire rope 100. The spacing of the buttons 104 is selected to correspond to the adjustment range of the turnbuckle 80. FIG. 7 shows the wire rope 100 with the lowermost button 104 retained within the cup 90. The slot 94 receives the wire rope 100 therein and the projecting sides of the plastic button 104 are gripped by the upper face 92 of the cup 90. As indicated in FIG. 6, the loop 88 will be attached to the remainder of the lock down apparatus by a clevis 84.

FIG. 7 also shows a lifting pole 110 with a hook 112 on the end thereof suitable for releasably gripping a button 104 so that the lock down apparatus may be lifted to the point where the loop 102 is slipped over the end of the hook 46 that is attached to the walking beam 14 of the pumping unit 12. The lifting pole 110 may conveniently comprise a pole commonly used with swimming pool brushes and like pool implements, generally having a length of about 12 feet and being light enough in weight but strong enough to lift the upper end of the lock down apparatus to engagement with the hook 46.

When the lock down apparatus 10 is to be placed in use, the turnbuckle 80 is swivelled to the extended position, the lower end 78 is connected to the bottom clamp 60 by the clevis 72 and the retaining hooks 66 are adjusted to firmly hold the clamp member 60 against the cross beam 64. One of the buttons 104 is placed within the cup 90 to be retained in the slot 94 and the upper end of the apparatus is lifted by the lifting hook 110 to place the loop 102 on the hook 46. If there is too much slack in the apparatus as thus installed, the loop 102 is removed from the hook 46 and a different button 104 is positioned within the cup 90, after which the loop 102 is again placed over the hook 46. After proper adjustment in this fashion, the turnbuckle 80 is swivelled to take up the remaining slack and render the lock down apparatus taut. Following installation in this manner, the safety brake of the pump unit (not shown) is released momentarily so that the lock down apparatus holds the walking beam 14 in a safe position against the weight of the counterbalance 17. The safety brake may then be again applied for added safety.

With this arrangement, the lock down apparatus of the invention serves to hold the beam 14 against release, even if the safety brake should somehow slip or be inadvertently released. The lock down apparatus is easy and simple to use, is constructed of components which for the most part are readily available and of relatively low cost. Thus, a most effective, simple, reliable lock down apparatus is provided to fill the need which is common with the conventional oil well pumping units of the type described.

Although there have been described hereinabove various specific arrangements of a PUMPING UNIT LOCK DOWN APPARATUS in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A lock down apparatus for securing a pump arm at a desired position relative to a pump unit base, said lock down apparatus comprising:

an upper attachment device coupled to the pump arm;

a lower attachment device coupled to the pump unit base; and an adjustable length tensioning member connected to and extending between said upper and lower attachment devices for securing the pump arm in a desired position relative to the pump unit base.

2. The lock down apparatus of claim 1, wherein said pump arm includes an "I" beam having at least a lower flange portion and wherein said upper attachment device comprises a pair of C-shaped clamping members permanently affixed to said flange portion.

3. The lock down apparatus of claim 2 wherein said upper attachment device further comprises means for engaging a first end of said adjustable length tensioning member.

4. The lock down apparatus of claim 1, wherein said pump unit base includes a section of "I" beam having an upper extended flange portion and wherein said lower attachment device comprises a bracket defining a channel shaped to engage said flange portion.

5. The lock down apparatus of claim 1 further comprising coupling means for securely connecting said lower attachment device to a second end of said adjustable length tensioning member.

6. The lock down apparatus of claim 1, wherein said adjustable length tensioning member comprises a flexible portion of variable effective length and an adjustable tensioning portion.

7. The lock down apparatus of claim 6, wherein said flexible portion comprises a length of wire rope having coupling means at its first end for engaging said upper attachment device, and having along its length at least one stop element of increased diameter impressed upon said wire rope at a selected position for attachment to said adjustable tensioning portion.

8. The lock down apparatus of claim 7, wherein said at least one stop element of increased diameter comprises a plurality of stop elements of increased diameter impressed upon said wire rope at selectively spaced positions such that a selected one of said stop elements may be attached to said adjustable tensioning portion.

9. The lock down apparatus of claim 8, wherein said adjustable tensioning portion comprises a threaded turnbuckle having an adjustment range corresponding to the spacing between adjacent stop elements.

10. The lock down apparatus of claim 9, wherein the spacing between adjacent stop elements is chosen to correspond to the adjustment range of said turnbuckle.

11. The lock down apparatus of claim 8, wherein said threaded adjustment means comprise a turnbuckle assembly having first connecting means at one end for securely engaging with said lower attachment device and second connecting means at another end for releasably engaging a selected one of said stop elements.

12. The lock down apparatus of claim 11, wherein said second connecting means comprises a slotted member having a stop portion, the slot of said member extending into the stop portion and having a dimension wide enough to permit passage of the wire rope therethrough while blocking passage of the stop elements of increased diameter.

13. The lock down apparatus of claim 11, wherein said second connecting means comprises a hairpin connector having an open portion capable of receiving the wire rope and a narrower engaging portion for engaging a selected one of the stop elements of increased diameter.

14. The lock down apparatus of claim 2, wherein said upper attachment device further comprises a pair of side plates respectively affixed to said pair of clamping members, a mounting block having means for attaching said affixed plates and clamping members on opposite sides thereof, and additional attachment means for connecting a cable hook to said mounting block.

15. The lock down apparatus of claim 8, wherein each of the said stop elements is provided with a configuration adapted for engagement by a lifting hook used for lifting said wire rope to engage said upper attachment device.

16. The lock down apparatus of claim 4, wherein said lower attachment device further comprises at least one securing member connected to said bracket and configured to engage a cross beam and thereby prevent said bracket from disengaging said flange portion.

17. The lock down apparatus of claim 16, wherein the securing means comprise a pair of hooks having threaded ends extending through holes in said bracket and nuts threaded onto said threaded ends to tighten the securing members against said cross beam to preclude accidental release therefrom.

18. The lock down apparatus of claim 16, wherein said bracket further defines an opening adapted to receive a clevis for attachment to said adjustable length tensioning member.

* * * * *